US009011125B2

(12) United States Patent
Ehrenfeld et al.

(10) Patent No.: US 9,011,125 B2
(45) Date of Patent: Apr. 21, 2015

(54) VANE PUMP

(75) Inventors: Dirk Ehrenfeld, Hirrlingen (DE); Willi Schneider, Bodelshausen (DE); Torsten Helle, Tuebingen (DE)

(73) Assignee: Joma-Polytec GmbH, Bodelshausen (DE)

( * ) Notice: Subject to any disclaimer, the term of this patent is extended or adjusted under 35 U.S.C. 154(b) by 103 days.

(21) Appl. No.: 13/817,330

(22) PCT Filed: Jul. 27, 2011

(86) PCT No.: PCT/EP2011/062941

§ 371 (c)(1),
(2), (4) Date: Feb. 28, 2013

(87) PCT Pub. No.: WO2012/022595

PCT Pub. Date: Feb. 23, 2012

(65) Prior Publication Data

US 2013/0216419 A1 Aug. 22, 2013

(30) Foreign Application Priority Data

Aug. 16, 2010 (DE) ..... 10 2010 039 344

(51) Int. Cl.
*F04C 2/00* (2006.01)
*F01C 21/08* (2006.01)
*F04C 2/344* (2006.01)

(52) U.S. Cl.
CPC . *F04C 2/00* (2013.01); *F01C 21/08* (2013.01); *F04C 2/3442* (2013.01); *F04C 2250/20* (2013.01)

(58) Field of Classification Search
USPC ..... 418/131–133, 75, 79–80, 259, 266–268
See application file for complete search history.

(56) References Cited

U.S. PATENT DOCUMENTS 4,231,727 A * 11/1980 Buchholz et al. ..... 418/76
5,222,886 A * 6/1993 Fischer et al. ..... 418/133

FOREIGN PATENT DOCUMENTS

| | | |
|---|---|---|
| DE | 101 60 036 | 9/2002 |
| DE | 102007039172 | 12/2008 |
| DE | 102008036327 | 2/2010 |

* cited by examiner

*Primary Examiner* — Mary A Davis
*Assistant Examiner* — Wesley Harris
(74) *Attorney, Agent, or Firm* — Henry M. Feiereisen LLC

(57) ABSTRACT

A vane pump includes at least one vane, a pump housing with a bottom and a lid, and a rotor rotatably mounted in the pump housing, with the at least one vane being slidingly mounted in a groove in the rotor and having at least one vane tip which protrudes from the outer peripheral surface of the rotor and rests upon the inner peripheral surface of the pump housing so that the vane defines with the bottom and the lid an intake chamber and a pressure chamber to respectively interact with a radially outer inlet opening and outlet opening in the bottom and/or in the lid, wherein the rotor is provided on the peripheral edge with a chamfer in facing relationship to the housing bottom and/or the housing lid having the inlet opening and/or outlet opening.

4 Claims, 4 Drawing Sheets

VANE PUMP

CROSS-REFERENCES TO RELATED APPLICATIONS

This application is the U.S. National Stage of International Application No. PCT/EP2011/062941, filed Jul. 27, 2011, which designated the United States and has been published as International Publication No. WO 2012/022595 and which claims the priority of German Patent Application, Serial No. 10 2010 039 344.4, filed Aug. 16, 2010, pursuant to 35 U.S.C. 119(a)-(d).

BACKGROUND OF THE INVENTION

The invention relates to a vane pump with at least one vane, a pump housing with a bottom and lid and a rotor rotatably mounted in the pump housing, with the at least one vane being slidingly mounted in a groove in the rotor and having at least one vane tip which protrudes from the outer peripheral surface of the rotor and bears upon the inner peripheral surface of the pump housing so that the vane defines with the bottom and the lid an intake chamber and a pressure chamber to respectively interact with a radially outer inlet opening and outlet opening in the bottom and/or in the lid.

DE 10 2008 036 327 A1 discloses a vane pump having a pump housing in which a rotor is arranged. This rotor supports several vanes which bear against the inner peripheral side of the housing and divides the pump chamber into work spaces. The bottom of the pump housing has inlet and outlet openings which are swept by the vanes. ft has been shown that the inlet and outlet openings have to be spaced sufficiently far apart to prevent the rotor, in which the vanes are mounted, from extending over the openings or a part of the openings so as to cover this part. This means, however, that the openings are always spaced at a distance to the optimum intake and discharge point. The latter theoretically lies at an area where the rotor contacts the inner peripheral surface of the pump housing.

SUMMARY OF THE INVENTION

The invention is based on the object to provide a vane pump with a higher efficiency.

This object is attained in accordance with the invention for a vane pump of the afore-mentioned type by providing the rotor on the peripheral edge with a chamfer which faces the bottom and/or lid having the inlet opening and/or outlet opening.

In the vane pump according to the invention, the peripheral edge of the rotor, located directly at the inlet opening and/or the outlet opening, is provided with a chamfer so that the rotor has a certain distance from the bottom or lid in the region of this peripheral edge as a result of this chamfer. As the rotor can therefore no longer cover the inlet opening and/or outlet opening as a result of the chamfer, the inlet opening and/or outlet opening can be shifted closer to the optimal point.

In a preferred embodiment, the chamfer has a triangular cross-section so that the chamfer has a first portion in confronting relation to the inner peripheral surface and a second portion in confronting relation to the bottom or the lid. Such a chamfer is easy to produce.

The second portion facing the bottom or lid is dimensioned at least as long as the radial dimension of the inlet opening and/or the outlet opening. This ensures that the inlet opening and/or the outlet opening is covered by the rotor neither in its entirety nor partly.

The chamfer may hereby extend over the entire peripheral edge, or, according to an alternative embodiment, the chamfer extends over a portion of the peripheral edge. This portion extends between two radial mouths of one or more grooves for receiving a vane. In a single-vane pump, the rotor has one groove, and in a multi-vane pump, the rotor has a correspondingly greater number of grooves. The chamfer always extends between two mouths, even when the single groove is open only to one side.

In order to achieve an optimal deflection of inflowing or outflowing fluid, the chamfer steadily decreases in the direction of the mouth. The chamfer becomes therefore smaller in the direction of the mouth so as to merge continuously into the vane.

Advantageously, the peripheral edge is formed with no chamfer in immediate proximity to the mouth of the groove. The chamfer thus ends immediately before the mouth of the groove begins. The transition of the chamfer for immediate proximity to the mouth of the groove is rounded advantageously.

BRIEF DESCRIPTION OF THE DRAWING

Further advantages, features and details of the invention become apparent from the sub-claims and the following description which describes in detail two particularly preferred exemplary embodiments with reference to the drawing. The features shown in the drawing and set forth in the description and the claims can be essential to the invention by themselves or in any combination.

It is shown in the drawing in.

DETAILED DESCRIPTION OF PREFERRED EMBODIMENTS

Figure 1:
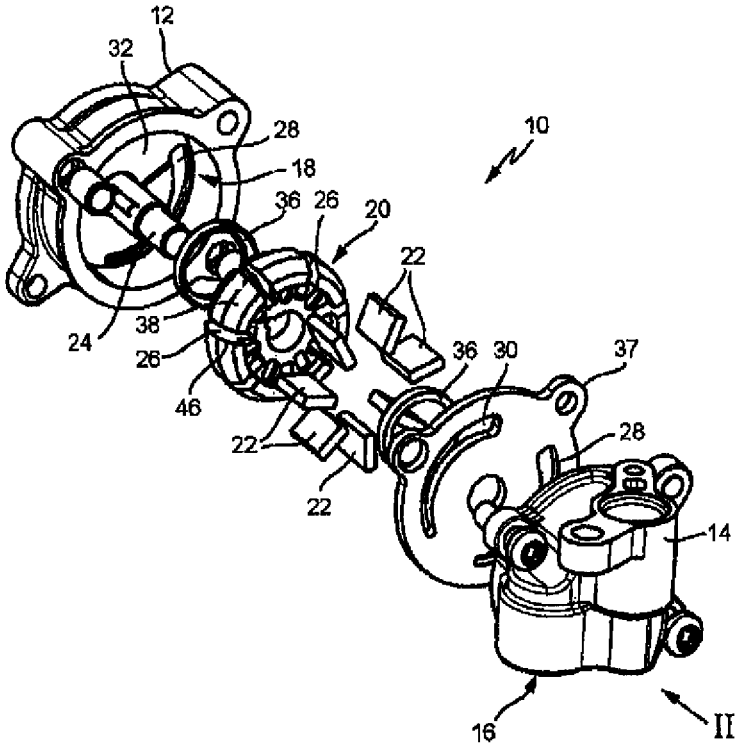
FIG. 1 an exploded illustration of an exemplary embodiment of the vane pump according to the invention.

Reference sign 10 designates in FIG. 1 a vane pump which is illustrated with opened pump housing 12. The pump housing 12 has an intake port 14 which is provided on a housing lid 16 and feeds into a pump interior space 18. A rotor 20, generally designated with 20, is accommodated in this pump interior space 18 for movably supporting a plurality of vanes 22 in orthogonal relationship to the pivot shaft 24. Each vane 22 is mounted in a groove 26 for radial displacement, with the grooves 26 being evenly spaced about over the circumference on the rotor 20. The pump interior space 18 houses the rotor 20 with the vanes 22, with the vanes 22 defining the work spaces there between. The intake port 14 feeds into these work spaces via an inlet opening, with the compressed fluid being expelled via an outlet opening 30. The outlet opening is not visible in the housing bottom 32.

Figure 2:
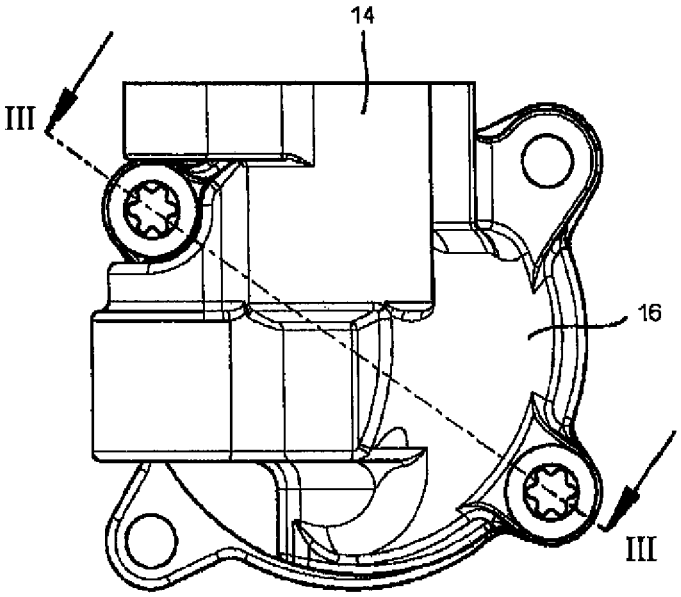
FIG. 2 a top view of the vane pump in the direction of the arrow II according to FIG. 1.
Figure 3:
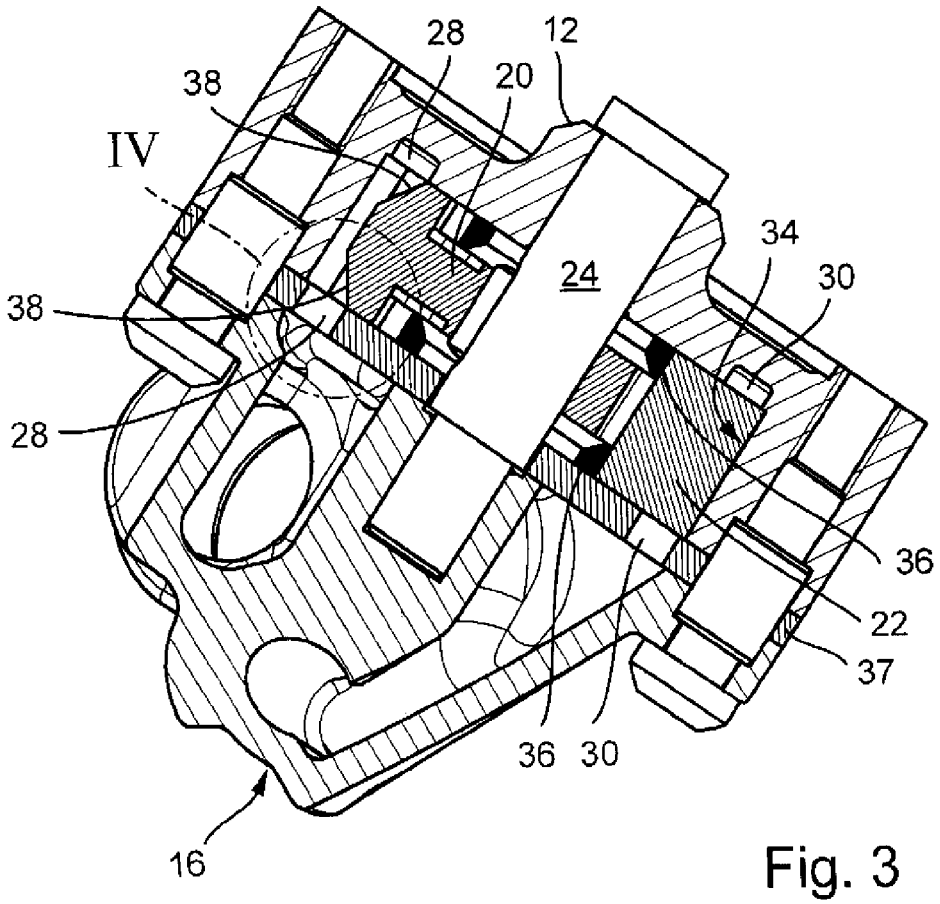
FIG. 3 a section III-III according to FIG. 2.

FIG. 3 shows a section III according to FIG. 2 and clearly depicts the pivot shaft 24 and the rotor 20 attached thereto. Moreover, a vane 22 is illustrated in section and rests upon the inner peripheral wall 34 of the pump interior space 18. The vane 22 is held in this position by two positioning rings 36. Moreover, the inlet openings 28 and outlet openings 30 are clearly visible, which are provided in the housing lid 16 and in the housing bottom 32. The inlet opening 28 and the outlet opening 30 may hereby also be provided in a disk 37, as this is implemented in the illustrated exemplary embodiment, so that the housing lid 16 is easier to manufacture.

Figure 4:
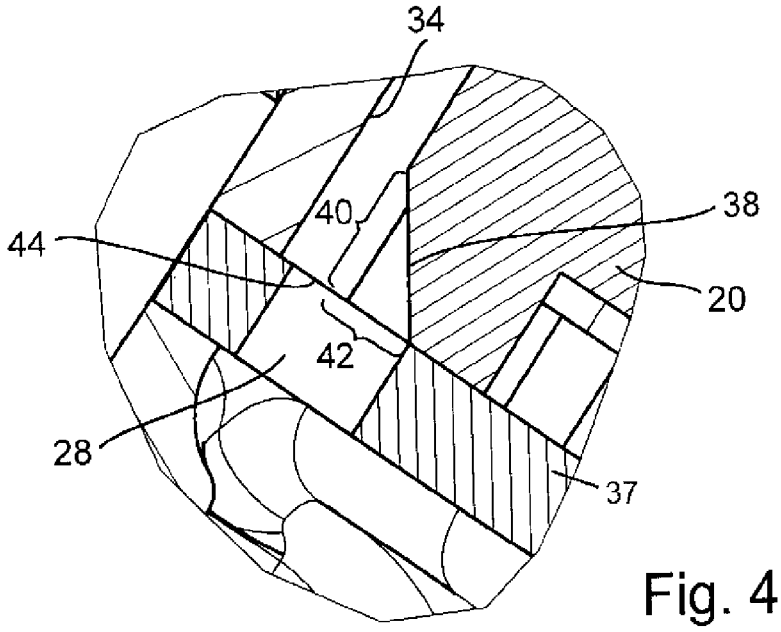
FIG. 4 an enlarged reproduction of the section IV according to FIG. 3.

The rotor 20 has two virtual peripheral edges, each of which being provided with a chamfer 38, as shown in detail in FIG. 4. The chamfer has a first portion 40 which extends parallel to the pivot shaft 24, and a second portion 42 which extends parallel to the housing lid 16 or to the housing bottom 32. The virtual peripheral edge 44 extends at the intersection of the two portions 40 and 42. The portion 42 is dimensioned so as to end at the edge of the inlet opening 28. In this way, it is ensured that the inlet opening 28 is not covered by the rotor 20. The fluid is therefore able to flow through the inlet opening 28 and at the chamfer 38 into the work space. Likewise, the fluid is able to flow unimpeded along the chamfer 38 towards the outlet opening 30 and there through in order to exit the pump interior space 18.

FIG. 1 shows a variant of the invention in which the chamfer 38 is sized to extend up to the mouth 46. In a variant, not shown, the size of the chamfer steadily decreases and ends immediately before the mouth so that the inflow and the outflow of the fluid is deflected in an optimum manner.

Figure 5:
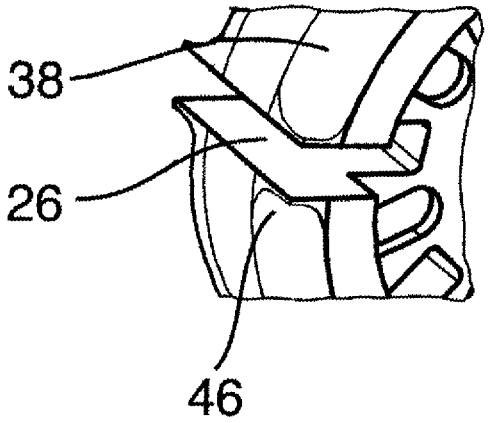
FIG. 5 an enlarged reproduction of a detail of FIG. 1 in an area of a rotor groove.

FIG. 5 shows a variant of the peripheral pump according to the invention, in which the peripheral edge 44 is formed without the chamfer 38 in immediate proximity to the mouth 46 of the groove 26.

The invention claimed is:

1. A vane pump, comprising a pump housing having housing bottom and housing lid;

a rotor rotatably mounted in the pump housing and having an outer peripheral surface; and at least one vane movably mounted in a groove in the rotor and sized to protrude from the outer peripheral surface of the rotor and to bear upon an inner peripheral wall of the pump housing, said at least one vane defining with a member selected from the group consisting of the housing bottom and the housing lid a work space which has radially outer inlet and outer outlet openings formed in the member, said rotor having a peripheral edge which is provided with a chamfer in facing relationship to the member, wherein the peripheral edge is formed without chamfer in immediate proximity to a mouth of the groove.

2. The vane pump of claim 1, wherein the chamfer has a first portion in confronting relation to the inner peripheral wall and a second portion in confronting relation to the member.

3. The vane pump of claim 2, wherein the second portion is sized at least as long as a radial dimension of the inlet opening or the outlet opening.

4. The vane pump of claim 1, wherein the chamfer is sized to extend over the peripheral edge in its entirety.

* * * * *